US005820442A

United States Patent [19]

Helder

[11] Patent Number: 5,820,442

[45] Date of Patent: Oct. 13, 1998

[54] SUPER SOUND ENGINE/TRANSMISSION SOUND ENHANCER

[76] Inventor: Glenn R. Helder, 60 Roseville Ave., Saint James, N.Y. 11780

[21] Appl. No.: 761,841

[22] Filed: Dec. 9, 1996

[51] Int. Cl.[6] ..... H03G 3/00; A63H 5/00

[52] U.S. Cl. ..... 446/404; 381/61; 340/441

[58] Field of Search ..... 446/409, 404, 446/397; 381/61, 71, 86

[56] References Cited

U.S. PATENT DOCUMENTS

| | | | |
|---|---|---|---|
| 4,325,199 | 4/1982 | McEdwards | 446/409 |
| 5,088,955 | 2/1992 | Ishimoto | 446/409 |
| 5,237,617 | 8/1993 | Miller | 381/61 |
| 5,314,372 | 5/1994 | Kramer | 446/409 |

*Primary Examiner*—Robert A. Hafer
*Assistant Examiner*—Laura Fossum
*Attorney, Agent, or Firm*—Michael I. Kroll

[57] ABSTRACT

The present invention relates to an electronic engine sound duplicator simulator used in combination with an internal combustion motor, a battery, and an alternator. The sound duplicator simulator includes a motor rpm sensor, a sound duplicator microprocessor, an amplifier, a sound trim adjuster and a switch. When the internal combustion engine is powered, the microprocessor converts the rpm signal into a frequency modulated electric signal which generates a sound simulating that of a high performance vehicle. The sound trim adjuster prevents the frequency modulated electrical signal from being transmitted to the speaker means when there is a predetermined low motor rpm. The stitch is mounted on the dashboard of a vehicle for turning the microprocessor and amplifier on and off.

1 Claim, 3 Drawing Sheets

SUPER SOUND ENGINE/TRANSMISSION SOUND ENHANCER

BACKGROUND OF THE INVENTION

1. Field of the Invention

The present invention relates to a mechanical and/or electronic supercharger simulator. More particularly, the present invention relates to a mechanical and/or electronic supercharger simulator which generates a sound which resembles a race car emanating from a vehicle, for use in both cars and boats to enhance the sound thereof.

2. Description of the Prior Art

Electronic and mechanical devices which produce sound are well known in the art. They range in scope from bicycles to automobiles. However, none are mechanically and/or electronically linked to a motor's rpm.

Numerous innovations for a supercharger/transmission/engine sound duplicator have been provided in the prior art that are described as follows. Even though these innovations may be suitable for the specific individual purposes to which they address, they differ from the present invention as hereinafter contrasted.

In U.S. Pat. No. 4,949,068, titled Motorcycle Sound Simulator for a Child's Toy, invented by John Johnston and Dee Jordan, a device for simulating the sound of a motorcycle as a child's toy in which the simulated sound is composed of at least two rectangular waves partially out of phase with each other, mixed and amplified. The frequency (and preferably the volume) of the mixed rectangular waves varies with the position of a rotatable simulated throttle.

In U.S. Pat. No. 4,875,885, titled Engine Noise Simulating Device for a Bicycle, invented by Horton Johnson, a noisemaker for bicycles and the like includes a housing having a shoulder and a resonator plate seated in the housing on the shoulder. The resonator plate is biased against the shoulder by a compressed spring. A resonator chamber extends from the shoulder, away from the housing. Use of a camming mechanism which raises the resonator plate above the shoulder and releases same as it passes so that the resonator plate is urged back against the shoulder by the spring and a surface-engaging noise and air compression noise are directed into the resonator chamber to simulate the sound commonly associated with a vehicle engine.

In U.S. Pat. No. 4,680,020, titled Toy Vehicle Having Simulated Engine Noise, invented by Melvin R. Kennedy, Dietmar Nagel, and Abraham A. Arad, a free-wheeling toy vehicle which when propelled makes a repetitive sound simulating the noise of an internal combustion engine. The vehicle includes a chassis having bearings supporting front and rear wheel axles. Lying on top of the chassis between the axles is a drum having an elastic drum head. Cantilevered from one end of the chassis is a clapper formed of a flat metal spring terminating in a striker, the spring being biased so that the striker normally rests on the drum head. A finger projects downwardly from the clapper, the tip of the finger being successively engaged by the equispaced teeth of a hub mounted on one of the wheel axles and turning therewith. Each time the finger tip is engaged by a moving tooth, the finger is pushed forward to raise the striker above the drum head; and when the finger then falls between adjacent teeth, the striker is released to hit the drum head to generate a thumping sound. The repetition rate of the clapper action depends on the running speed of the vehicle and therefore acts to create a realistic motor noise.

In U.S. Pat. No. 4,290,054, titled Electrical Apparatus and Method for Electrically Simulating a Noise, invented by Michel Magnani and Moxhel Moulin, an electrical apparatus and method for electrically simulating noise resulting from the thermodynamic expansion of a gas inside a chamber whose volume is varied, is characterized in that it comprises, in series, a capacitor of fixed capacitance and means for varying with respect to time the potential at least one of the terminals of the capacitor, the potential variation depending on the variation of the volume with respect to time and on the nature of said expansion.

In U.S. Pat. No. 2,459,860, titled Engine Noise Equipment, invented by Claude K. Wilkinson, this invention relates to a noise maker and has for an object to provide an improved noise maker especially adapted for simulating the noise made by an engine or motor in operation, particularly that produced by an aircraft motor.

The above patented inventions differ from the present invention because the lack one or more features of the following described and claimed in the present invention: mechanical supercharger simulator housing having a mechanical supercharger simulator housing egress port and a mechanical supercharger simulator housing ingress port, a mechanical supercharger simulator shaft which comprises a plurality of mechanical supercharger simulator flexible fins longitudinally disposed thereon, an electronic supercharger/transmission/engine sound duplicator microprocessor, an electronic supercharger/transmission/engine sound rpm sensor, an electronic supercharger/transmission/engine sound speaker, an electronic supercharger/transmission/engine sound switch, an electronic supercharger/transmission/engine sound volume control, electronic supercharger/transmission/engine sound trim adjuster, and vacuum sensor.

Numerous innovations for a supercharger/transmission/engine sound duplicator have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a mechanical and/or electronic supercharger simulator. More particularly, the present invention relates to a mechanical and/or electronic supercharger simulator which generates a sound which resembles a race car emanating from a vehicle, such as the mechanical whine of a gear train from a high performance transmission, or such from a gear train of rotors of a type positive displacement blower or supercharger.

The types of problems encountered in the prior art are engines produced are so muffled for sound and pollution that the awesome sounds of the vehicles of yesteryears are not present in today's cars.

In the prior art, unsuccessful attempts to solve this problem were attempted namely: reducing muffling and back pressure. However, the problem was solved by the present invention because the heightened muffling and back pressure can remain while still emanating an awesome sound of yesteryears sound.

Innovations within the prior art are rapidly being exploited in the automotive field.

The present invention went contrary to the teaching of the art which teaches reduced muffling and back pressure.

The present invention solved a long felt need for a mechanical and or electronic supercharger/transmission/engine sound duplicator which is linked to a motor's rpm.

Accordingly, it is an object of the present invention to provide a supercharger/transmission/engine sound duplicator which comprises a mechanical supercharger simulator housing having a mechanical supercharger simulator housing egress port and a mechanical supercharger simulator housing ingress port.

More particularly, it is an object of the present invention to provide a supercharger/transmission/engine sound duplicator which comprises a mechanical supercharger simulator shaft which comprises a plurality of mechanical supercharger simulator flexible fins longitudinally disposed thereon.

In keeping with these objects, and with others which will become apparent hereinafter, one feature of the present invention resides, briefly stated, in a supercharger/transmission/engine sound duplicator which comprises an electronic supercharger/transmission/engine sound duplicator microprocessor and amplifier.

When the supercharger/transmission/engine sound duplicator is designed in accordance with the present invention, it further comprises an electronic supercharger/transmission/engine sound rpm sensor.

In accordance with another feature of the present invention, the supercharger/transmission/engine sound duplicator further comprises an electronic supercharger/transmission/engine sound speaker.

Another feature of the present invention is that the supercharger/transmission/engine sound duplicator further comprises an electronic supercharger/transmission/engine sound switch.

Yet another feature of the present invention is that the supercharger/transmission/engine sound duplicator further comprises an electronic supercharger/transmission/engine sound volume control.

Still another feature of the present invention is that the supercharger/transmission/engine sound duplicator further comprises an electronic supercharger/transmission/engine sound trim adjuster.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

COMMON COMPONENTS OF EMBODIMENTS

24—battery (24)
24A—battery ground (24A)
24BA—battery first positive lead (24BA)
24BB—battery second positive lead (24BB)
26—motor (26)
26A—motor main pulley (26A)
26B—motor alternator (26B)
26BA—motor alternator belt (26B)
26BBA—motor alternator first positive lead (26BBA)
26BBB—motor alternator second positive lead (26BBB)
26BC—motor alternator second negative lead (26BC)

FIRST EMBODIMENT

10—mechanical supercharger simulator (10)
12—mechanical supercharger simulator housing (12)
12A—mechanical supercharger simulator housing egress port (12A)
12B—mechanical supercharger simulator housing ingress port (12B)
14A—mechanical supercharger simulator front bearing (14A)
14B—mechanical supercharger simulator back bearing (14B)
16—mechanical supercharger simulator shaft (16)
18—mechanical supercharger simulator flexible fin (18)
20—mechanical supercharger simulator pulley (20)
20A—mechanical supercharger simulator pulley groove (20A)
20B—mechanical supercharger simulator pulley belt (20B)
22A—mechanical supercharger simulator intake air (22A)
22B—mechanical supercharger simulator egress air (22B)

SECOND EMBODIMENT

110—electronic supercharger/transmission/engine sound duplicator simulator (110)
112—electronic supercharger/transmission/engine sound duplicator microprocessor (112)
114—electronic supercharger/transmission/engine sound rpm sensor (114)
116—electronic supercharger/transmission/engine sound speaker (116)
116A—electronic supercharger/transmission/engine sound speaker positive lead (116A)
116B—electronic supercharger/transmission/engine sound speaker negative lead (116B)
118—electronic supercharger/transmission/engine sound switch (118)
120—electronic supercharger/transmission/engine sound volume control (120)
122—electronic supercharger/transmission/engine sound trim adjuster (122)
124—amplifier
126—vacuum sensor

DESCRIPTION OF THE PREFERRED EMBODIMENT

Figure 1:
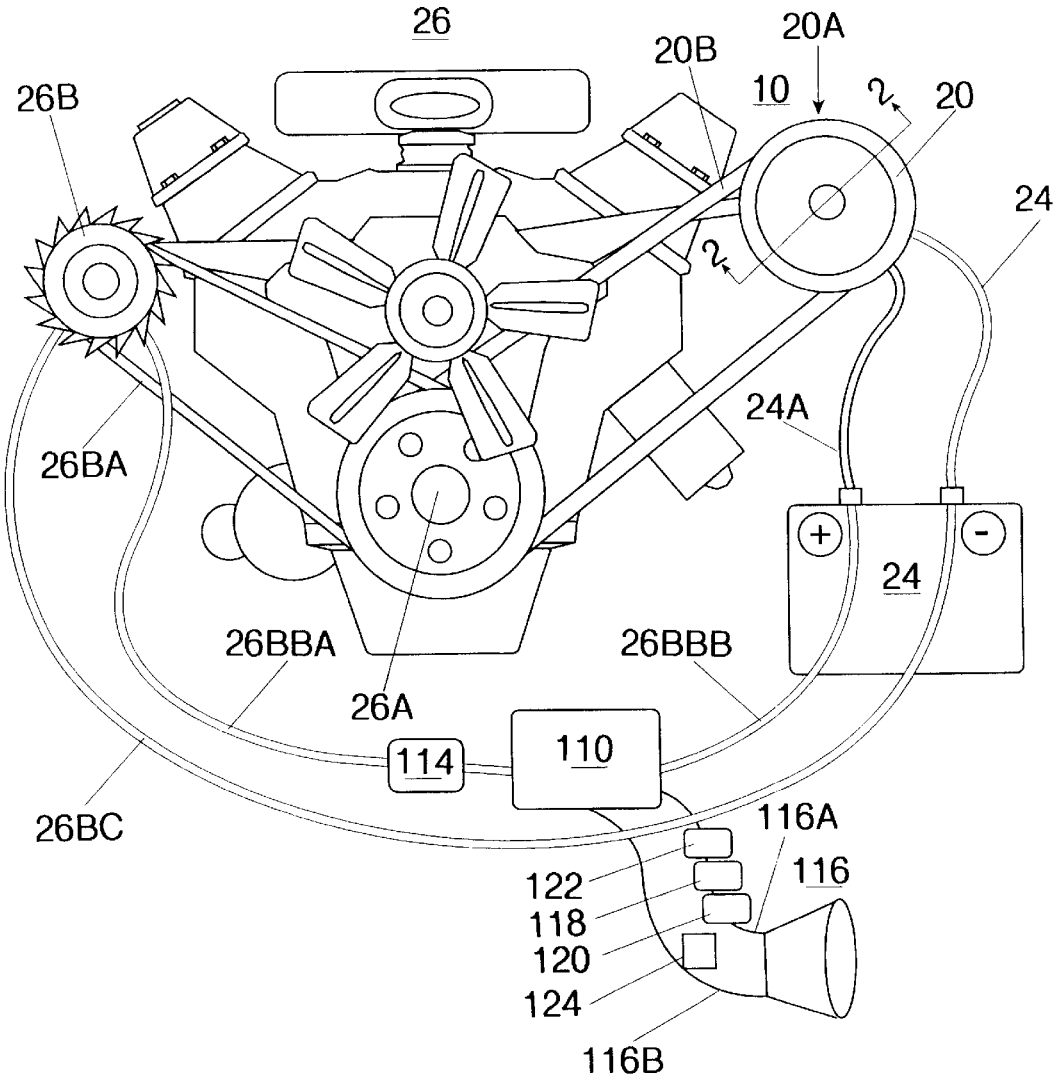
FIG. 1 is a front view of a motor exhibiting a mechanical supercharger simulator and an electronic supercharger/transmission/engine sound duplicator simulator integrally incorporated thereon and electrically therein, respectively.

Firstly, referring to FIG. 1 which is a front view of a motor (26) exhibiting a mechanical supercharger simulator (10) and an electronic supercharger/transmission/engine sound duplicator simulator (110) integrally incorporated thereon and electrically therein, respectively. The mechanical supercharger simulator (10) comprises a mechanical supercharger simulator housing (12) which comprises a mechanical supercharger simulator housing egress port (12A) wherein mechanical supercharger simulator intake air (22A) enters and a mechanical supercharger simulator housing ingress port (12B) wherein mechanical supercharger simulator egress air (22B) emanates from producing a race car simulated sound, the sound of a gear train from a high performance transmission, and/or the sound produced by type positive displacement blowers gear train and rotors. The mechanical supercharger simulator (10) further comprises a mechanical supercharger simulator front bearing (14A) securely mounted at a front distal end within the mechanical supercharger simulator housing (12). The mechanical supercharger simulator (10) further comprises a mechanical supercharger simulator back bearing (14B)securely mounted at a rear distal end within the mechanical supercharger simulator housing (12). The mechanical supercharger simulator (10) further comprises a mechanical supercharger simulator shaft (16) rotatably mounted within and through the mechanical supercharger simulator front bearing (14A) and rotatably mounted within the mechanical supercharger simulator back bearing (14B). The mechanical supercharger simulator shaft (16) is mounted in an off-center position closer to the mechanical supercharger simulator housing egress port (12A). The mechanical supercharger simulator (10) further comprises at least one mechanical supercharger simulator pulley (20) securely mounted at a distal end of the mechanical supercharger simulator shaft (16). The at least one mechanical supercharger simulator pulley (20) comprises a mechanical supercharger simulator pulley groove (20A) where in a complimentary configured mechanical supercharger simulator pulley belt (20B) frictionally engages. The mechanical supercharger simulator (10) functions by the mechanical supercharger simulator pulley belt (20B) which is rotated by a motor main pulley (26A) of a motor (26). The mechanical supercharger simulator pulley belt (20B) engages the at least one mechanical supercharger simulator pulley (20) which in turn rotates the mechanical supercharger simulator shaft (16) and concurrently rotates the plurality of mechanical supercharger simulator flexible fins (18) which are extended entrapping air when rotating past the mechanical supercharger simulator housing ingress port (12B) and contracted compressing the air when rotating past the mechanical supercharger simulator housing egress port (12A) releasing the compressed air there through emanating a race car sound therefrom, and/or the sound of a gear train from a high performance transmission, and/or the sound produced by type positive displacement blowers gear train and rotors.

The mechanical supercharger simulator housing (12), the mechanical supercharger simulator shaft (16), and the mechanical supercharger simulator pulley (20) are manufactured from a material selected from a group consisting of metal, metal alloy, plastic, plastic composite, rubber composite, fiberglass, epoxy and carbon-graphite.

An electronic supercharger/transmission/engine sound duplicator simulator (110) which is incorporated into an electrical system of a motor (26) wherein the motor (26) comprises at least one battery (24) having a battery ground (24A), a battery first positive lead (24BA) and a battery second positive lead (24BB) which is electrically connected by a motor alternator first positive lead (26BBA) to a motor alternator (26B) having a motor alternator belt (26B) which is rotatably and frictionally connected to a motor main pulley (26A). The motor alternator (26B) further comprises a motor alternator second negative lead (26BC) which is electrically connected to a battery ground (24A). The electronic supercharger/transmission/engine sound duplicator simulator (110) comprises an electronic supercharger/transmission/engine sound rpm sensor (114) which is electrically connected to the motor alternator first positive lead (26BBA). The electronic supercharger/transmission/engine sound rpm sensor (114) functions to convert an engines rpm to an electronic signal. The electronic supercharger/transmission/engine sound duplicator simulator (110) comprises an electronic supercharger/transmission/engine sound duplicator microprocessor (112) and amplifier which are electrically connected to the electronic supercharger/transmission/engine sound rpm sensor (114) and receives the engine rpm electronic signal therefrom. The electronic supercharger/transmission/engine sound duplicator microprocessor (112) functions to convert the engine rpm electronic signal into a frequency modulated electric signal. The electronic supercharger/transmission/engine sound duplicator microprocessor (112) and amplifier are electrically connected to the battery (24) by a motor alternator second positive lead (26BBB). The electronic supercharger/transmission/engine sound duplicator simulator (110) comprises an electronic supercharger/transmission/engine sound speaker (116) which is electrically connected to the electronic supercharger/transmission/engine electronic supercharger/transmission/engine sound speaker positive lead (116A) which electrically transmits the frequency modulated electric signal from the electronic supercharger/transmission/engine sound duplicator microprocessor (112) and amplifier to the electronic supercharger/transmission/engine sound speaker (116) emanating sound therefrom. The electronic supercharger/transmission/engine sound speaker negative lead (116B) further comprises an electronic supercharger/transmission/engine sound speaker negative lead (116B) electrically connected to the battery ground (24A).

The electronic supercharger/transmission/engine sound duplicator microprocessor (112) optionally has removable microchips that can be changed to simulate different sounds. The microchip simulates a sound of a roots type positive displacement blower. The microchip simulates a sound of a high performance transmission/engine of a sports car selected from a group consisting of, but not limited to, FERRARI (Tm), BMW (Tm), CORVETTE (Tm), PORSCHE (Tm), MASERATI (Tm), and LAMBORDINI (Tm).

The electronic supercharger/transmission/engine sound duplicator simulator (110) further comprises an electronic supercharger/transmission/engine sound switch (118) electrically connected between the electronic supercharger/transmission/engine sound duplicator microprocessor (112), the switch (118) shuts off all power to the unit, and the electronic supercharger/transmission/engine sound speaker (116). The electronic supercharger/transmission/engine sound duplicator simulator (110) further comprises an electronic supercharger/transmission/engine sound volume control (120) electrically connected to the amplifier of the electronic supercharger/transmission/engine sound switch (118) which is connected to the electronic supercharger/transmission/engine sound speaker (116). The electronic supercharger/transmission/engine sound switch (118) is mounted on a vehicle's dashboard. The electronic supercharger/transmission/engine sound switch (118) further comprises indicia thereon, the indicia is "BOOST".

The sound duplicator simulator (/transmission/engine sound trim adjuster (122) is electrically connected between the electronic supercharger/transmission/engine sound duplicator microprocessor (112) and the electronic supercharger/transmission/engine sound switch (118), and may also be connected to the engine manifold by a vacuum sensor. The electronic supercharger/"transmission"/engine sound trim adjuster (122) functions to prevent the frequency modulated electric signal from the electronic supercharger/transmission/engine sound duplicator microprocessor (112) from transmission to the electronic supercharger/transmission/engine sound speaker (116) at low motor (26) rpms, when the transmission sound microprocessor is being used. While the vehicle is standing still at idle the trim would be in off position when the engine sound or blower sound microprocessors are being used.

Figure 2:
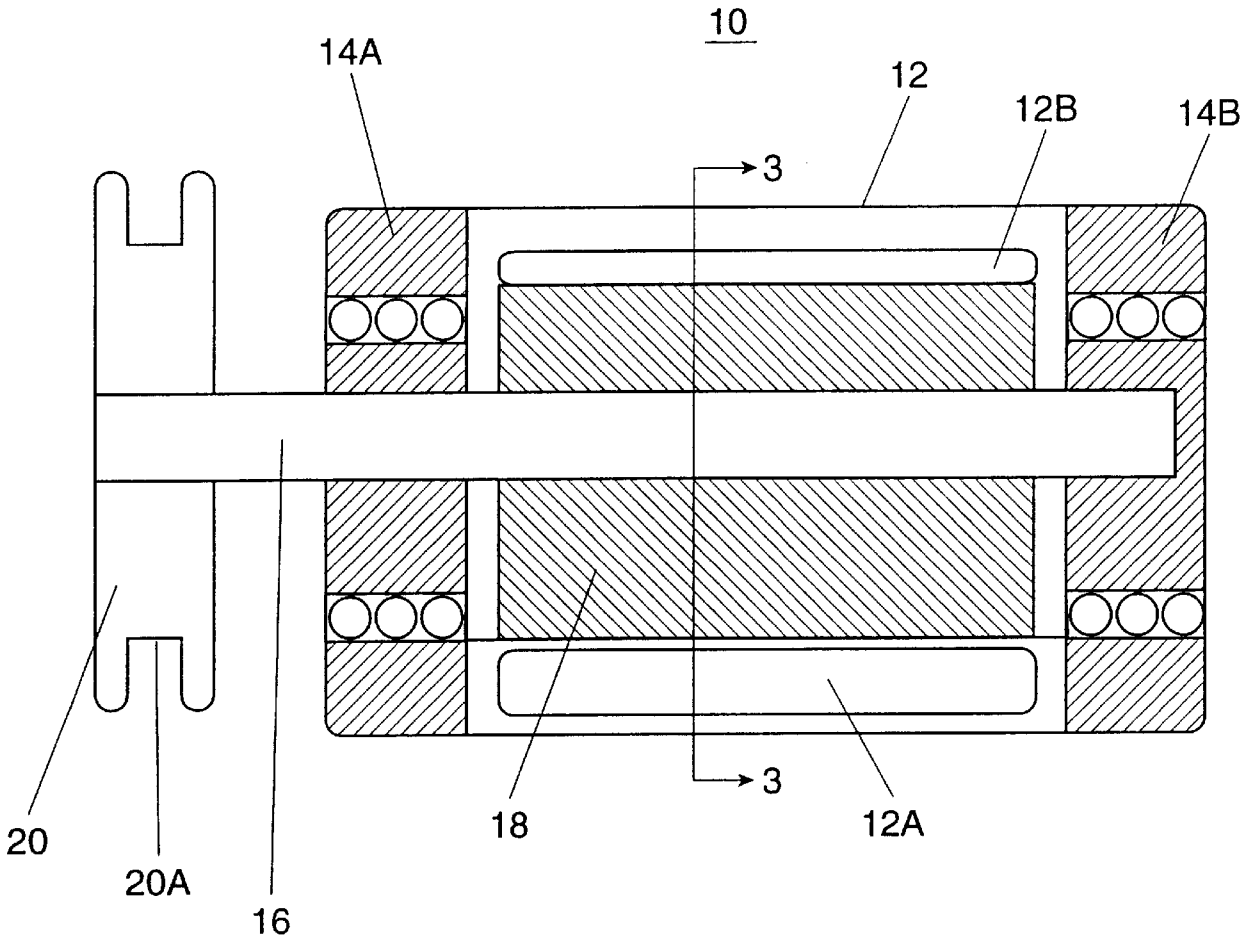
FIG. 2 is a longitudinal cross sectional view of a mechanical supercharger simulator along line 2—2 of FIG. 1.
Figure 3:
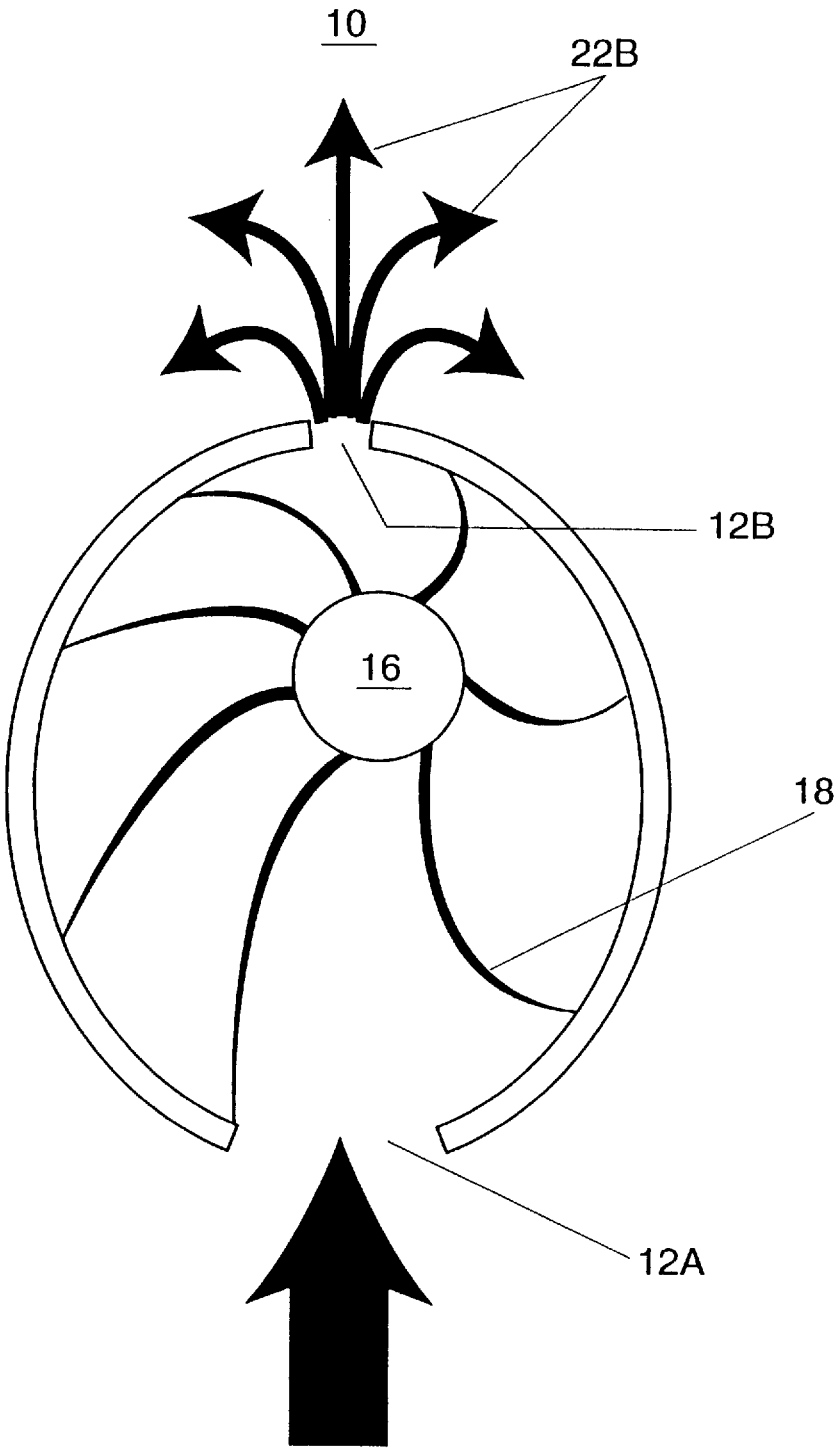
FIG. 3 is a lateral cross sectional view of a mechanical supercharger simulator along line 3—3 of FIG. 2.

Referring to FIG. 2 and FIG. 3 which are a longitudinal cross sectional view of a mechanical supercharger simulator (10) along line 2—2 of FIG. 1 and a lateral cross sectional view of a mechanical supercharger simulator (10) along line 3—3 of FIG. 2, respectively. The mechanical supercharger simulator (10) further comprises a plurality of mechanical supercharger simulator flexible fins (18) circumferentially longitudinally disposed upon the mechanical supercharger simulator shaft (16) between the mechanical supercharger simulator front bearing (14A) and the mechanical supercharger simulator back bearing (14B) within the mechanical supercharger simulator housing (12). The plurality of mechanical supercharger simulator flexible fins (18) are constructed from a flexible. The plurality of mechanical supercharger simulator flexible fins (18) are each constructed from a flexible resilient material selected from a group consisting of rubber, rubber composite, plastic, plastic composite and metal alloy.

It will be understood that each of the elements described above, or two or more together, may also find a useful application in other types of constructions differing from the type described above.

While the invention has been illustrated and described as embodied in a supercharger simulator, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An electronic supercharger/transmission/engine sound duplicator simulator in combination with an internal combustion motor, a battery, and an alternator comprising:

A) a motor rpm sensor electrically connected to said alternator for converting motor rpm to an electronic signal;

B) sound duplicator microprocessor and amplifier means electrically connected to the positive terminal of said battery to receive electrical power and to said rpm sensor to receive said electronic signal for converting the rpm electronic signal into a frequency modulated electric signal based solely on said rpm signal;

C) speaker means for receiving the frequency modulated electric signal for generating a sound which simulates that of a predetermined high performance vehicle, said microprocessor and amplifier means having replaceable microchips for selecting the high performance vehicle whose sound is to be simulated;

D) sound trim adjuster means electrically connected to said microprocessor and amplifier means for preventing the frequency modulated electrical signal from being transmitted to said speaker means when there is a predetermined low motor rpm; and E) switch means adapted to be mounted on the dashboard of a vehicle containing said simulator for turning off power to said microprocessor and amplifier means.

* * * * *